US008459169B2

(12) United States Patent
Kachtan et al.

(10) Patent No.: US 8,459,169 B2
(45) Date of Patent: Jun. 11, 2013

(54) GUNNER PLATFORM PROTECTOR

(75) Inventors: Yoash Kachtan, Kibbutz Dafna (IL); Ariel Ravid, Kibbutz Hayelet Hashachar (IL)

(73) Assignee: Plasan Sasa Ltd., M.P. Marom Hagalil (IL)

( * ) Notice: Subject to any disclaimer, the term of this patent is extended or adjusted under 35 U.S.C. 154(b) by 0 days.

(21) Appl. No.: 13/191,261

(22) Filed: Jul. 26, 2011

(65) Prior Publication Data

US 2012/0036989 A1 Feb. 16, 2012

(30) Foreign Application Priority Data

Jul. 26, 2010 (IL) ..... 207237

(51) Int. Cl.
*F41H 7/00* (2006.01)

(52) U.S. Cl.
USPC ..... 89/36.07

(58) Field of Classification Search
USPC ..... 89/36.07, 36.08, 3.136; 180/68.1
See application file for complete search history.

(56) References Cited

U.S. PATENT DOCUMENTS

| | | | | |
|---|---|---|---|---|
| 3,024,704 | A | 3/1962 | Even | |
| 3,145,620 | A * | 8/1964 | Even | 89/36.08 |
| 4,492,282 | A * | 1/1985 | Appelblatt et al. | 180/68.1 |
| 4,587,880 | A * | 5/1986 | Sprafke | 89/36.14 |
| 4,667,565 | A * | 5/1987 | Anderson | 89/36.08 |
| 4,671,162 | A * | 6/1987 | Adlam et al. | 89/1.13 |
| 4,771,673 | A * | 9/1988 | Miller | 89/36.14 |
| 4,836,085 | A * | 6/1989 | Winkler et al. | 89/45 |
| 5,079,960 | A | 1/1992 | Kauer et al. | |
| 7,942,092 | B1 * | 5/2011 | Kiel et al. | 89/36.13 |
| 2012/0031261 | A1 * | 2/2012 | Gagnon et al. | 89/36.13 |
| 2012/0111181 | A1 * | 5/2012 | Brill et al. | 89/36.08 |
| 2012/0118133 | A1 * | 5/2012 | Saucedo | 89/36.02 |

FOREIGN PATENT DOCUMENTS

| | | |
|---|---|---|
| EP | 1508768 | 2/2005 |
| GB | 864389 | 4/1961 |
| GB | 2462346 | 2/2010 |
| JP | 6055091 | 7/1994 |
| RU | 2009108623 | 9/2010 |

* cited by examiner

*Primary Examiner* — Michelle Clement
(74) *Attorney, Agent, or Firm* — Workman Nydegger

(57) ABSTRACT

A support for use with an armored vehicle, the support comprising a frame having a plurality of longitudinally extending beams connected to one another and forming therebetween a convex polygon. The support further comprises a plurality of attachment elements configured for carrying the frame and for being attached to a vehicle roof. The support is configured for being mounted on a roof of the vehicle and for carrying thereupon a gunner protection kit. The polygon is sufficiently big so as not to obstruct a top hatch of the vehicle. The ends of at least some of the beams extend beyond the polygon, and are configured for engagement with the attachment elements thereby carrying the frame by the ends.

19 Claims, 3 Drawing Sheets

GUNNER PLATFORM PROTECTOR

CROSS-REFERENCE TO RELATED APPLICATIONS

This application claims priority to Israel Patent Application No. 207237 filed on 26 Jul. 2010, the contents of which are incorporated herein, in their entirety, by this reference.

TECHNICAL FIELD

This invention relates to supports for carrying gunner protection kits on armored vehicles.

BACKGROUND

It is well known in the art to provide a gunner protection kit atop an armored vehicle. Such a kit typically comprises armored sidewalls which protect a gunner who stands partially out of a hatch in the roof of the vehicle to access and use a roof-mounted gun or canon. Supports may be provided to both facilitate connection of the gunner protection kit to the vehicle, as well as enable rotation thereof.

SUMMARY

According to one aspect of the present invention, there is provided a support for use with an armored vehicle, the support comprising:

a frame comprising a plurality of longitudinally extending beams connected to one another and forming therebetween a convex polygon; and a plurality of attachment elements configured for carrying the frame and for being attached to a vehicle roof;

wherein the support is configured for being mounted on a roof of the vehicle and for carrying thereupon a gunner protection kit, the polygon being sufficiently big so as not to obstruct a top hatch of the vehicle, and wherein ends of at least some of the beams extend beyond the polygon, and being configured for engagement with the attachment elements thereby carrying the frame by the ends.

As a result of the above design, the beams forming the convex polygon are arranged such that each of a majority of such beams extends tangent to a circle inscribed within the convex polygon.

The arrangement can further be such that the ends of the beams extending outside the polygon are free of connection with one another. The attachment elements may also be configured to carry the frame free of any connection means therebetween. In other words, each attachment element is configured for attachment to the roof of the vehicle at a certain location thereof, and each end of a beam is configured for individual attachment to a corresponding attachment element.

The frame may be configured to be connected to periphery portions of the roof. The support may be designed such that at least some of the attachment elements are connected to the roof directly above sidewalls of the vehicle.

Each of the attachment elements may be attached to the roof via a bolt. For this purpose, each of the attachment elements may comprise a through-going shaft for receipt therethrough of the bolt, and the roof of the vehicle can be formed with a corresponding port for receiving the bolt and for attachment of the attachment element.

Each of the attachment elements may comprise top and bottom flanges defining a central throat therebetween. One of the top and bottom flanges may be formed separately from the throat and other of the top and bottom flanges.

The attachment element may further comprise a fork element configured to carry a corresponding portion of the beams the frame. The fork element may comprise two prongs giving rise to a space therebetween, the space being configured to receive therein the web of the beams. The fork element may also comprise a ring-portion configured to be securely fitted about the throat.

Each of the attachment elements may comprise a cushioning element configured to absorb energy between the roof and the frame. The cushioning elements may be, on the one hand, of sufficient stiffness to bear the weight of the frame and the gunner protection kit, and on the other hand, be sufficiently resilient to allow cushioning/shock absorbing during an explosion at the vicinity of the vehicle.

The frame may be designed so as to be fully secured to the roof when the proper portions of the beams are slideably received by the attachment elements when the attachment elements are attached to the roof.

The beams may have an I-shaped cross-section comprising a web spanning between two flanges. In addition, the flanges of the beams may taper toward each other at the ends. The ends of the beams may further comprise a ring-portion configured to be securely fitted about the throat.

All of the ends carried by attachment elements attached to one of the sides of the roof may be formed parallel to one another.

The support may comprise three ends or less configured to be carried by attachment elements attached to any one side of the roof.

The frame may be made of a ballistic material, for example armored steel.

The attachment elements may be made of an elastomeric material.

The support may further comprise the gunner protection kit.

According to another aspect of the present invention, there is provided a vehicle comprising a support as described above.

The construction of the support as described above may provide several advantages. For example:

The support may be easily and quickly mounted and dismounted to the roof of a vehicle, using only simple tools. In particular, the attachment via a fork element may reduce mounting time;

Easy mounting/removal of the support from the vehicle can also prove advantageous when the vehicle is loaded onto a transport vehicle, for example a transport aircraft (such as Lockheed C-130 Hercules), which imposes height constraints on the vehicles being transported thereby;

The support is mainly connected to the peripheral area of the roof by energy absorbing elements. In the case of a detonation below the vehicle, shock waves typically reach the roof, causing it to rise and fall. Due to the fact that much of the weight of the gunner platform is borne by the sidewalls of the vehicle, this rising and falling will not result in the gunner platform crashing through the roof of the vehicle;

The frame, or at least a majority thereof (i.e., excluding the ends of the beams) occupies only a central portion of the roof of the vehicle, i.e., besides the points of connection between the support and the roof, the support does not occupy the peripheral area of the roof;

The frame, and at least the polygonal portion thereof, is made of straight beams. This construction prevents twisting of the frame;

The arrangement under which only the ends of the beams are attached to the periphery of the roof of the vehicle provides the entire support, and hence the gunner platform, with a certain flexibility, since the gunner platform is suspended in a trampoline-like manner from the periphery of the roof.

The support is of low weight.

BRIEF DESCRIPTION OF THE DRAWINGS

In order to understand the invention and to see how it may be carried out in practice, an embodiment will now be described, by way of a non-limiting example only, with reference to the accompanying drawings, in which.

DETAILED DESCRIPTION OF EMBODIMENTS

Figure 1A:
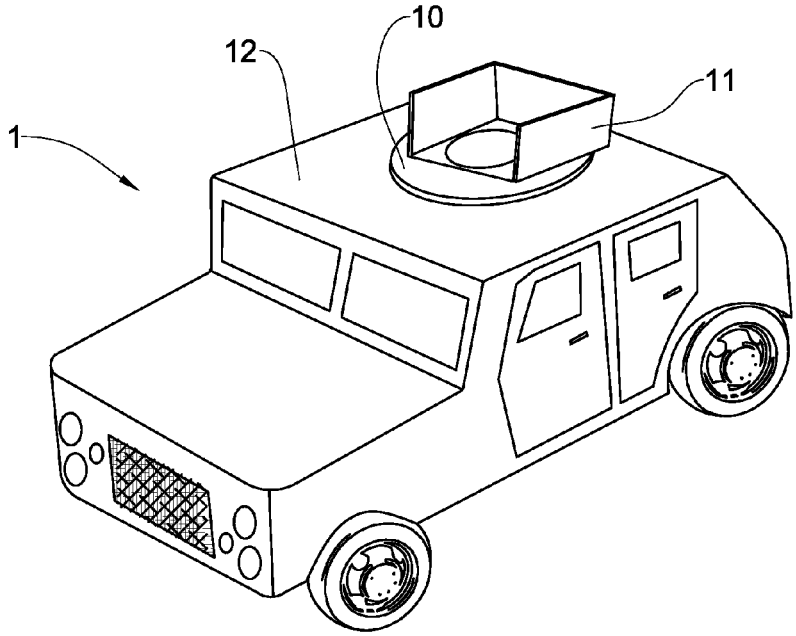
FIG. 1A is a perspective view of a vehicle carrying a gunner protection kit using a support according to an embodiment of the present invention.
Figure 1B:
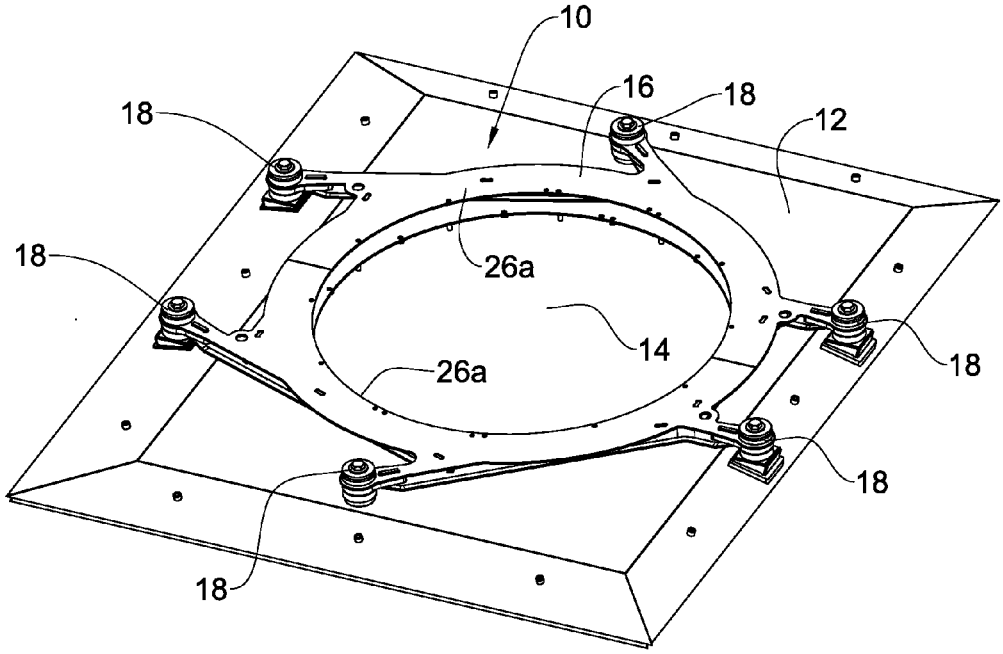
FIG. 1B is a perspective view of the support illustrated in FIG. 1A, mounted on the roof of the vehicle illustrated in FIG. 1A.

As illustrated in FIGS. 1A and 1B, there is provided a support, which is generally indicated at 10, for use with a vehicle 1, and specifically for use to carry thereupon a gunner protection kit (hereafter "GPK", indicated by 11 in FIG. 1A). The support 10 is designed to be attached/mounted to the roof 12 of the vehicle, and may be connected in any suitable manner to the GPK, and/or part of the support may constitute a portion of the GPK.

The vehicle may be an armored vehicle, and the roof 12 may comprise a hatch 14, constituted by an opening in the roof, allowing access for a gunner to project therethrough, e.g., in a standing position. The GPK surrounds the hatch 14, typically on three sides, and provides armored protection to the gunner.

The support 10 comprises a frame 16 and a plurality of attachment elements 18 configured for being attached to the roof 12 and for carrying the frame.

Figure 1C:
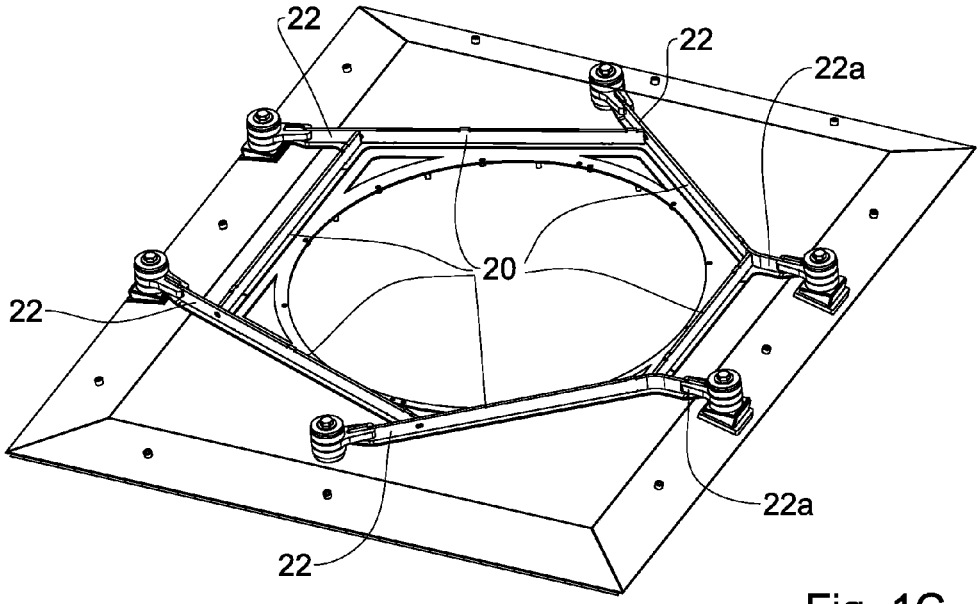
FIG. 1C is a perspective view of the support illustrated in FIG. 1B, with a top flange thereof removed.

As best seen in FIG. 1C, the frame 16 comprises a plurality of straight longitudinally extending beams 20 connected to one another and forming a convex polygon, for example a hexagon. The polygon is formed so as not to obstruct the hatch 14 when the support 10 is mounted to the roof 12 of the vehicle. At least some of the beams 20 comprise ends 22 which extend beyond the polygon.

The ends 22 are designed to carry the frame 16 and thus cooperate with the attachment elements 18 to connect the frame 16, and thereby the support 10 is attached to periphery portions of the roof 12, at least some of which may be directly over sidewalls of the vehicle. Some of the beams 22 are curved, while others are straight (this however, is not compulsory, and all the beams can be straight).

The frame 16 may be made of a ballistic material, for example armored steel.

It is also observed that all of the ends 22*a* which are carried by attachment elements 18 attached to one of the sides of the roof 12, are oriented parallel to each other.

Figure 2:
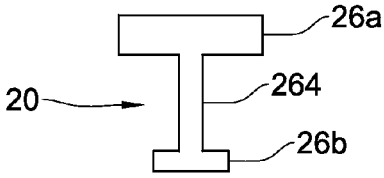
FIG. 2 is a cross-sectional view of a frame of the support illustrated in FIGS. 1A through 1C, taken along line II-II in FIG. 1B.

As illustrated in FIG. 2, the beams 20 may be formed having an I-shaped cross-section (i.e., as an I-beam), having a vertically disposed web 24 spanning between upper and lower flanges 26*a*, 26*b* (reference numeral 26 will be used herein to refer to the upper and lower flanges collectively). This geometry provides a high degree of strength in the vertical direction, which is suitable for bearing the weight of the GPK on the frame 16, at a relatively low weight.

The upper flange 26*a* may have a varying size, for example to impart a predetermined shape to the upper part of the frame, and may be always larger than the lower flange 26*b*. For example, the inner edges of the upper flanges 26*a* of all of the beams 20 may be in the form of a circle (as best seen in FIG. 1B), for example to facilitate rotation of the GPK therein. The upper flange may be formed with a ring-portion 28 at ends 22 of the beams, the purpose of which will be explained below.

Figure 3:
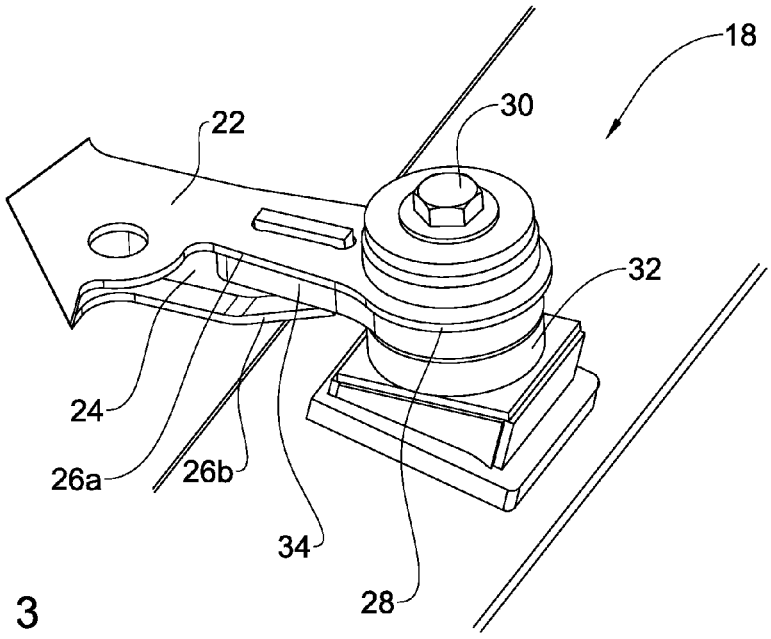
FIG. 3 is a close-up view of an attachment element and an end of a beam of the frame, both of the support illustrated in FIGS. 1A through 1C.

As seen in FIG. 3, the ends 22 of the beams 20 are designed such that the flanges 26 taper toward one another. Specifically, the lower flange 26*b* tapers toward the upper flange 26, resulting in a shortening of the web 24 in the vicinity of the tapering.

As further illustrated in FIG. 3, each attachment element 18 is attached to the roof 12 by a bolt 30. (It will be appreciated that the term "bolt" is used herein in its broadest sense, and encompasses all similar securing mechanisms, including, but not limited to, screws, pins, etc. which provide a fixed detachable attachment) It comprises a cushioning portion 32 and a fork element 34 designed for carrying the frame 16.

Figure 4:
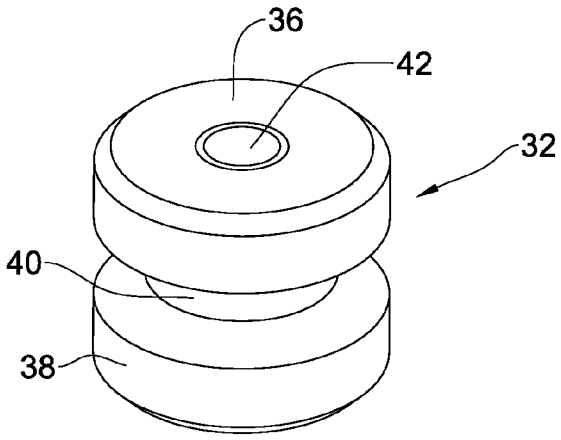
FIG. 4 is a perspective view of a cushioning element of the attachment element illustrated in FIG. 3.

The cushioning portion 32 is designed to absorb energy between the roof 12 of the vehicle, for example due to a blast therebelow, and the frame 16, as well as to provide a degree of flexibility therebetween. As such, it is made of an energy absorbent material, such as an elastomeric or viscoelastic material, e.g., rubber. The material is of sufficient stiffness to bear the weight of the frame and the GPK. As illustrated in FIG. 4, it comprises top and bottom flanges 36, 38 defining a central throat 40 therebetween.

Figure 5:
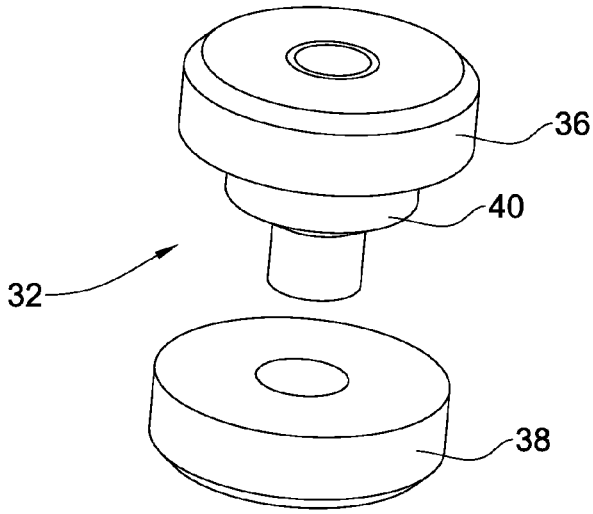
FIG. 5 is an exploded view of the cushioning element illustrated in FIG. 4.

As seen in FIG. 5, the bottom flange 38 is separate from the top flange 36 and throat 40, which are formed as a single unit, in order to ease assembly of the support 10. It will be appreciated that the cushioning portion 32 may be designed such that the top flange 36 may be separate from the bottom flange 38 and throat 40, which would be formed as a single unit. In addition, the cushioning portion comprises a through-going aperture 42 to receive therethrough the bolt 30.

Figure 6:
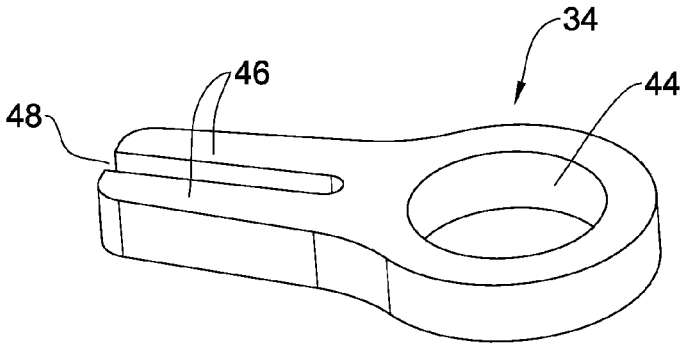
FIG. 6 is a perspective view of a fork element of the attachment element illustrated in FIG. 3.

As seen in FIG. 6, the fork element 34 may be made of a rigid material and comprise a ring-portion 44 at one end designed to snuggle receive therethrough the throat 40 of the cushioning portion 32, and a pair of parallel extending prongs 46 giving rise to a space 48 therebetween. The prongs 46 are designed such that the space 48 may snuggly receive therein the web of the ends 22 of the beams 20.

When assembled, the cushioning portion 32 of each of the attachment elements 18 is bolted to the roof, with a ring-portion 28, 44 of an end 22 of a beam 20 and of a fork element 34 securely fitted around the throat 40, with the ring-portion of the end of the beam being above that of the fork, so that the web of the beam is received within the space 48 between the prongs 46 of the form element, and the upper flange 26*a* of each end 22 is carried by an upper surface of a fork element 34. As the attachment elements 18 carry the frame 16 from several directions therearound, they may be free of connection means therebetween. This arrangement allows full securing of the frame 16 to the roof 12 when ends 22 thereof are slideably received by the attachment elements 18, facilitating simple mounting of the support on the roof of the vehicle.

The construction of the support 10 as described above may provide several advantages. For example:

- The support 10 may be easily and quickly mounted and dismounted to the roof 12 of a vehicle, using only simple tools. This may be particularly advantageous when the vehicle is loaded onto a transport vehicle, for example a transport aircraft (such as Lockheed C-130 Hercules), which imposes height constraints on the vehicles being transported thereby.
- The support 10 is mainly connected to the peripheral area of the roof 12 by energy absorbing elements. In the case of a detonation below the vehicle, shock waves typically reach the roof, causing it to rise and fall. As much of the weight of the GPK is borne by the sidewalls of the vehicle, this rising and falling will not result in the GPK crashing through the roof of the vehicle.
- The frame 12, or at least a majority thereof (i.e., excluding the ends 22 of the beams 20) occupies only a central portion of the roof 12 of the vehicle, i.e., besides the points of connection between the support 10 and the roof, the support does not occupy the peripheral area of the roof.
- The frame 16, and at least the polygonal portion thereof, is made of straight beams 20. This construction prevents twisting of the frame 16.
- The support 10 is of low weight.

Those skilled in the art to which this invention pertains will readily appreciate that numerous changes, variations and modifications can be made without departing from the scope of the invention mutatis mutandis.

The invention claimed is:

1. A support for use with an armored vehicle, the support comprising:

a frame comprising a plurality of longitudinally extending beams connected to one another and forming therebetween a convex polygon; and a plurality of attachment elements configured for carrying the frame and for being attached to a vehicle roof;

wherein the support is configured for being mounted on a roof of the vehicle and for carrying thereupon a gunner protection kit, the convex polygon being sufficiently sized so as not to obstruct a top hatch of the vehicle, and wherein ends of at least some of the beams that extend outside the polygon are free of connection with one another and configured for engagement with the attachment elements thereby carrying the frame by the ends.

2. The support according to claim 1, wherein the beams forming the convex polygon are arranged such that each of a majority of the beams extends substantially tangent to a circle inscribed within the convex polygon.

3. The support according to claim 1, wherein the attachment elements are configured to carry the frame free of any connection means therebetween.

4. The support according to claim 1, wherein each attachment element is configured for attachment to the roof of the vehicle at a certain location thereof, and each of the ends of the at least some of beams is configured for individual attachment to a corresponding one of the attachment elements.

5. The support according to claim 1, wherein each of the attachment elements further comprises a cushioning element configured to absorb energy between the roof and the frame.

6. The support according to claim 5, wherein the cushioning elements are of sufficient stiffness to bear the weight of the frame and the gunner protection kit.

7. The support according to claim 1, wherein the frame is designed so as to be fully secured to the roof when slideably received by the attachment elements when the attachment elements are attached to the roof.

8. The support according to claim 1, wherein the frame is configured to be connected to periphery portions of the roof.

9. The support according to claim 1, wherein at least some of the attachment elements are connected to the roof directly above sidewalls of the vehicle.

10. The support according to claim 1, wherein the beams have an I-shaped cross-section comprising a web spanning between two flanges.

11. The support according to claim 10, wherein flanges of the beams taper toward each other at the ends.

12. The support according to claim 1, wherein each of the attachment elements comprises top and bottom flanges defining a central throat therebetween.

13. The support according to claim 10, wherein the attachment element further comprises a fork element configured to carry the frame, and having two prongs giving rise to a space therebetween, the space being configured to receive therein the web of the beams.

14. The support according to claim 13, wherein the fork element comprises a ring-portion configured to be securely fitted about a throat defined between top and bottom flanges of the attachment elements.

15. The support according to claim 1, wherein all of the ends carried by attachment elements attached to one of the sides of the roof are formed substantially parallel to one another.

16. The support according to claim 1, comprising three ends or less of the beams configured to be carried by attachment elements attached to any one side of the roof.

17. The support according to claim 1, wherein the frame is made of armored steel.

18. The support according to claim 1, wherein the attachment elements are made of an elastomeric material.

19. A vehicle comprising a support according to claim 1.

* * * * *